US006276548B1

(12) United States Patent
Mitchell

(10) Patent No.: US 6,276,548 B1
(45) Date of Patent: Aug. 21, 2001

(54) COLLAPSIBLE BASKET

(76) Inventor: David Mitchell, 1019 Chamberlain Ave., Cincinnati, OH (US) 45215

( * ) Notice: Subject to any disclaimer, the term of this patent is extended or adjusted under 35 U.S.C. 154(b) by 0 days.

(21) Appl. No.: 09/679,991

(22) Filed: Oct. 5, 2000

(51) Int. Cl.[7] ..... B65D 6/00
(52) U.S. Cl. ..... 220/9.4; 220/6; 220/7; 220/9.2
(58) Field of Search ..... 220/9.4, 9.3, 9.2, 220/6, 7

(56) References Cited

U.S. PATENT DOCUMENTS

| | | | | |
|---|---|---|---|---|
| 357,040 | | 1/1887 | Sabin . | |
| 608,998 | * | 8/1898 | Apthorp | 220/9.2 |
| 1,119,429 | | 12/1914 | Jetter, Jr. . | |
| 1,263,294 | * | 4/1918 | Taylor | 220/9.3 |
| 1,444,487 | | 2/1923 | Volters . | |
| 2,020,766 | | 11/1935 | Brown . | |
| 2,638,399 | | 5/1953 | Seymour . | |
| 2,691,410 | | 10/1954 | Boucher . | |
| 3,094,361 | * | 6/1963 | Poyer | 220/9.2 X |
| 3,124,387 | | 3/1964 | Maclaren . | |
| 3,136,272 | | 6/1964 | Sprigman . | |
| 3,286,752 | | 11/1966 | Duryee, Jr. . | |
| 3,410,328 | * | 11/1968 | Sasai | 220/9.2 |
| 3,603,367 | | 9/1971 | Lehrman . | |
| 3,635,520 | | 1/1972 | Roher et al. . | |
| 4,547,015 | | 10/1985 | Wakimoto . | |
| 4,646,802 | | 3/1987 | Basore et al. . | |
| 4,717,201 | | 1/1988 | Barras . | |
| 5,507,548 | | 4/1996 | Marhefka . | |
| 5,806,864 | | 9/1998 | Zielinski et al. . | |
| 5,897,161 | | 4/1999 | Karg . | |
| 6,045,177 | | 4/2000 | Grace . | |

* cited by examiner

*Primary Examiner*—Steven Pollard
(74) *Attorney, Agent, or Firm*—Steven J. Rosen

(57) ABSTRACT

A collapsible basket has a collapsible frame with a collapsible sub-frame supported solely by collapsible frame sides. Each of the frame sides has a single pair of first and second leg members having first and second upper and lower ends. The first and second leg members in each of the frame sides are not connected together so that the first and second upper and lower ends are unrestrained with respect to distance between them when the frame is collapsed. The first and second upper ends of each of the pair of first and second leg members are pivotably connected to the sub-frame at pairs of relative spaced apart first and second positions on the sub-frame such that the first position in one of the pairs of relative spaced apart first and second positions is the second position in an adjacent one of the pairs of relative spaced apart first and second positions. The first and second lower ends of adjacent ones of the pair of first and second leg members are pivotably connected. The sub-frame includes side members extending between the first and second positions on the sub-frame. Each of the side members has first and second side ends pivotably connected to corresponding ones of the first and second upper ends of each of the pair of first and second leg members, respectively, and a pivotable joint between the first and second side ends. A bag having multiple sides attached to a bottom and having an open top is supportably connected to the sub-frame.

20 Claims, 6 Drawing Sheets

COLLAPSIBLE BASKET

BACKGROUND OF THE INVENTION

1. Field of the Invention

The invention relates in general to collapsible baskets.

2. Discussion of the Background Art

Collapsible baskets such as laundry and utility baskets and hampers are well known and useful. Typically, such baskets are made from frames supporting a bag having an open top. There is a need for a collapsible basket that is easily collapsed and reassembled and collapses into a small a volume as possible with the bag attached to the frame. It is also desirable that the basket be light-weight, strong, and safe such that it doesn't begin to collapse while in use. It is desirable that the basket be folded within the frame while still attached to the frame when the frame is collapsed for storage. It is also desirable that the frame may be built in a variety of sizes, shapes, and ratios of height to width and depth of the basket.

SUMMARY OF THE INVENTION

A collapsible basket includes a collapsible frame having a collapsible sub-frame supported solely by collapsible frame sides. Each of the frame sides has a single pair of first and second leg members having first and second upper and lower ends. The first and second leg members in each of the frame sides are pivotably connected together between the first and second upper and lower ends so that the first and second upper and lower ends are unrestrained with respect to a distance in height between them when the frame is collapsed. The first and second upper ends of each of the pair of first and second leg members are pivotably connected to the sub-frame at pairs of relative spaced apart first and second positions on the sub-frame such that the first position in one of the pairs of relative spaced apart first and second positions is the second position in an adjacent one of the pairs of relative spaced apart first and second positions. The first and second lower ends of adjacent ones of the pair of first and second leg members are pivotably connected. The sub-frame includes side members extending between the first and second positions on the sub-frame. Each of the side members has first and second side ends pivotably connected to corresponding ones of the first and second upper ends of each of the pair of first and second leg members, respectively, and a pivotable joint between the first and second side ends. A bag having multiple sides attached to a bottom and having an open top is supportably connected to the sub-frame.

An exemplary embodiment further includes lower blocks pivotably connected to the first and second lower ends of adjacent ones of the pair of first and second leg members and upper blocks pivotably connected to the first and second upper ends of adjacent ones of the pair of first and second leg members and corresponding side members. A locking means is used for locking the side members in a straight position about the pivotable joint between the first and second side ends. One such locking means includes spring loaded bolts disposed within the side members that are extendable and retractable across the pivotable joints. The bag is removably attached to the sub-frame and includes corner tabs removably attached to the upper blocks. Wheels or removable casters are mounted to the lower blocks. The leg members and the side members are tubular and the bag is made of a pliable material such as canvas.

An alternative embodiment includes collapsible cross bracing between the lower blocks. The cross bracing has bracing members pivotably connected to the lower blocks and pivotably connected to each other with a central block at a central location between the bracing members.

BRIEF DESCRIPTION OF THE DRAWINGS

The novel features believed characteristic of the present invention are set forth and differentiated in the claims. The invention is more particularly described in conjunction with the accompanying drawings in which:

DETAILED DESCRIPTION

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Figure 1:
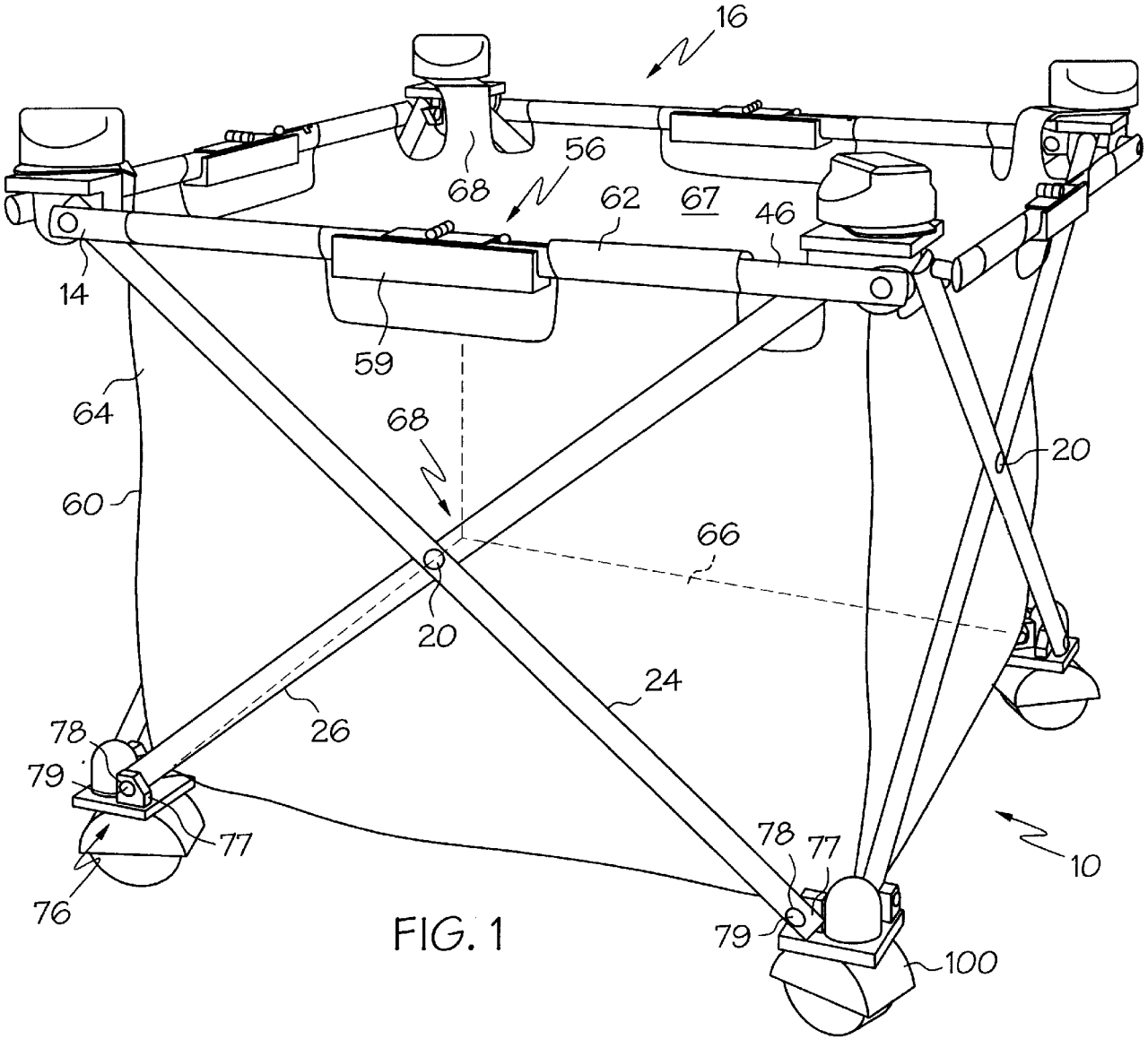
FIG. 1 is a perspective view illustration of an exemplary embodiment of a collapsible basket of the present invention.
Figure 2:
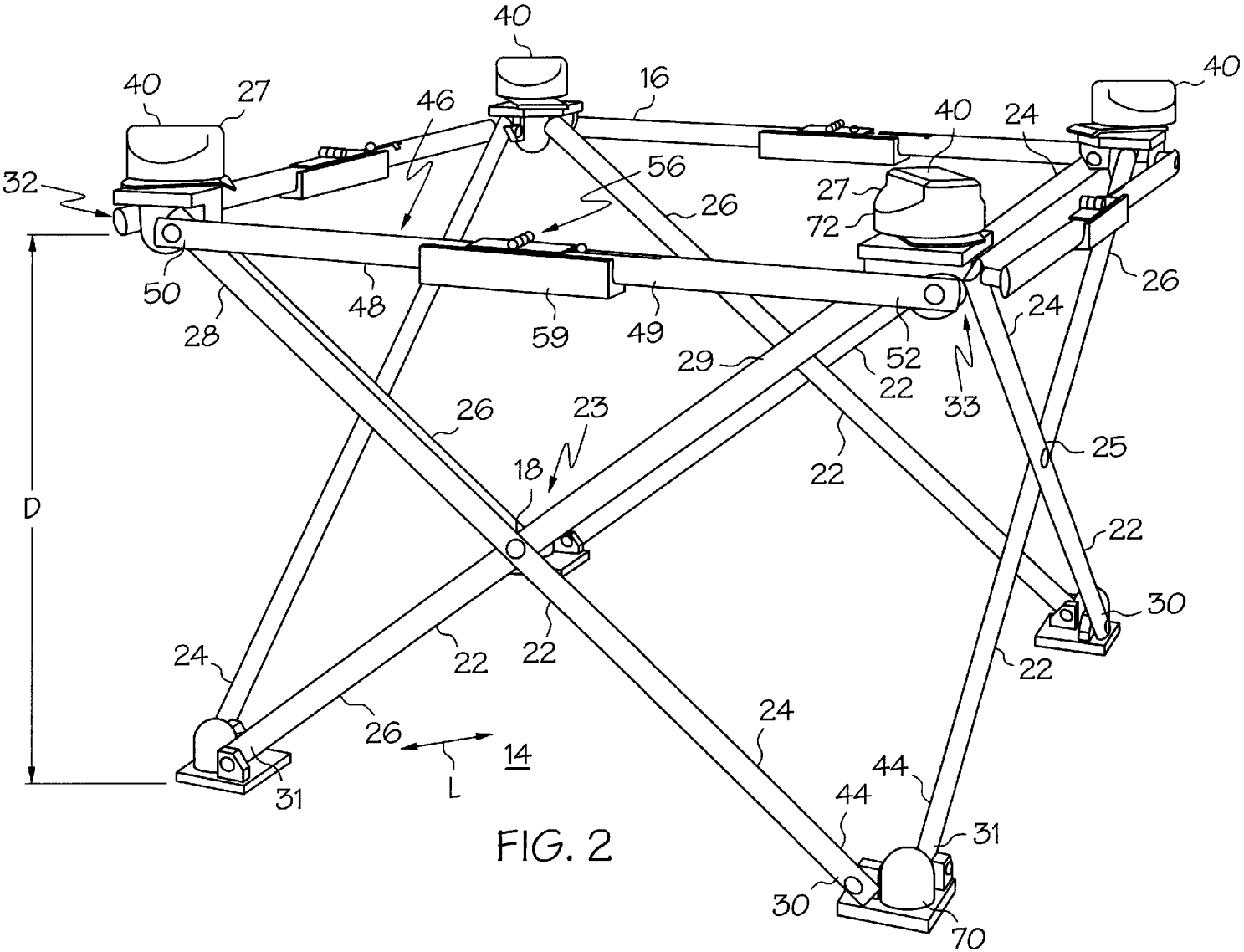
FIG. 2 is a perspective view illustration of a frame of the collapsible basket illustrated in FIG. 1.
Figure 6:
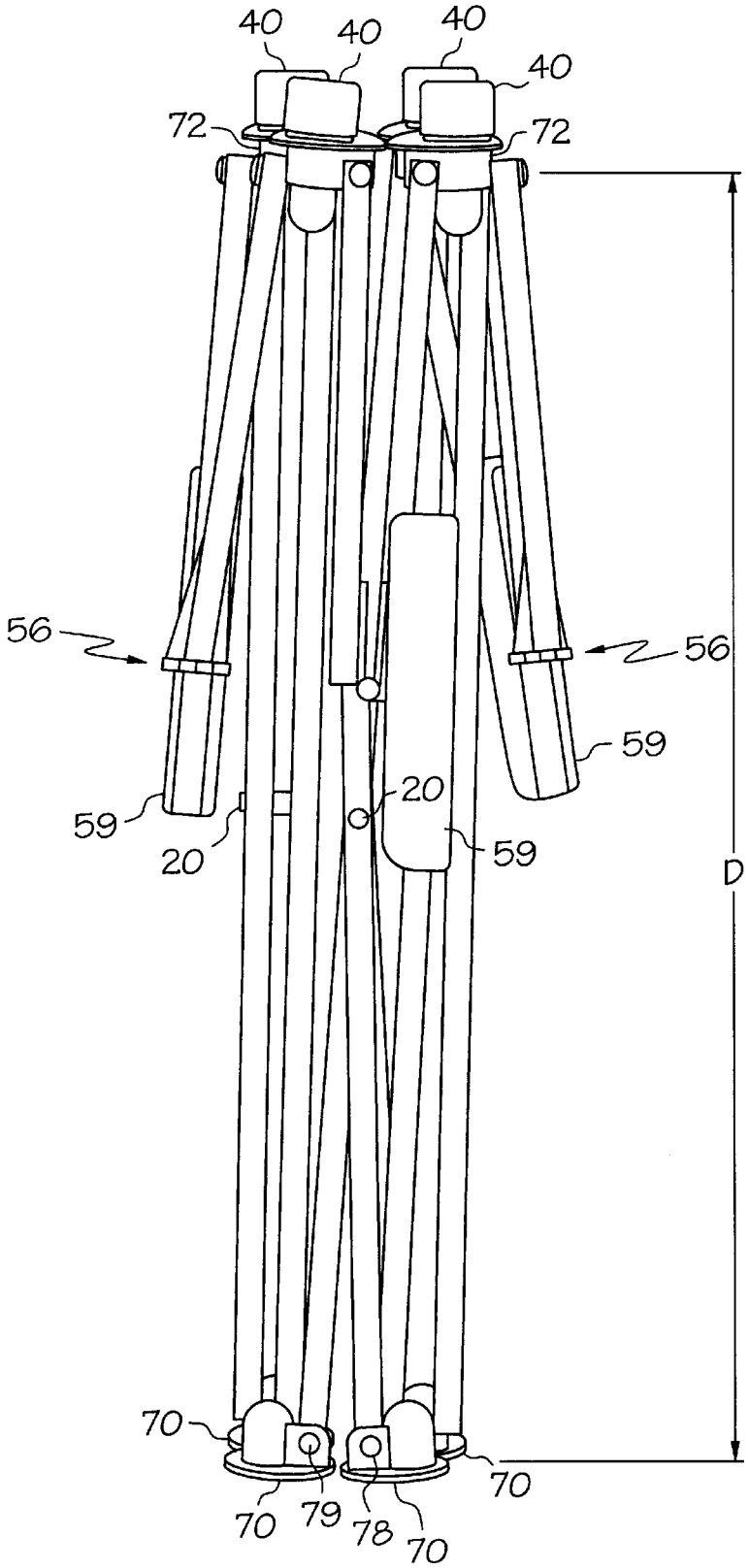
FIG. 6 is a perspective view illustration of the frame illustrated in FIG. 1 in its collapsed state.

Illustrated in FIG. 1 is an exemplary embodiment of a collapsible basket 10 of the present invention. The basket 10 includes a collapsible frame 14, more particularly illustrated in FIG. 2, having a collapsible sub-frame 16 supported solely by collapsible frame sides 18. Each of the frame sides 18 has a single pair 22 of first and second leg members 24, 26 with first and second upper ends 28, 29 and first and second lower ends 30, 31, respectively. The first and second leg members 24, 26 in each of the frame sides 18 are pivotably connected together with a pin joint 20 between the first and second upper and lower ends so that the first and second upper and lower ends and thus the upper ends 28, 29 are unrestrained with respect to the lower ends 30, 31 and a distance D in height between them varies when the frame 14 is collapsed (see FIG. 6).

The first and second upper ends 28, 29 of each pair 22 of the first and second leg members 24, 26 are pivotably connected to the sub-frame 16 at pairs 27 of relative spaced apart first and second positions 32, 33 on the sub-frame such that the first position 32 in a first one of the pairs 27 of relative spaced apart first and second positions 32, 33 is the second position 33 in an adjacent one 40 of the pairs of relative spaced apart first and second positions 32, 33. The first lower end 30 of each of the first leg member 24 in a first one 23 of the frame sides 18 is pivotably connected to an adjacent one of the second lower end 31 of the second leg members 26 in an adjacent one 25 of the frame sides.

Therefore, all of the first and second lower ends 30, 31 of adjacent ones of the pairs of first and second leg members 24, 26 in adjacent ones of the frame sides 18, respectively, are pivotably connected.

The sub-frame 16 includes side members 46 extending between the first and second positions 32, 33 on the sub-frame. Each of the side members 46 has first and second sections 48, 49 and first and second side ends 50, 52, respectively. The first and second sections 48, 49 are pivotably connected to corresponding ones of the first and second upper ends 28, 29 of each of the pairs 22 of first and second leg members 24, 26, respectively. A pivotable joint 56 between the first and second side ends 50, 52 pivotably connects first and second sections 48, 49 of each of the side members 46.

The first and second lower ends 30, 31 of adjacent ones 44 of the pairs 22 of first and second leg members 24, 26 are pivotably connected. The exemplary embodiment illustrated herein includes lower blocks 70, each of which pivotably connects the first and second lower ends 30, 31 of adjacent ones of the pairs 22 of first and second leg members 24, 26. Upper blocks 72 pivotably connect the first and second upper ends 28, 29 of adjacent ones of the pairs 22 of the first and second leg members 24, 26 and corresponding side members 46. Because the first and second leg members 24, 26 in each of the frame sides 18 are not connected together the lower and upper blocks 70, 72 are relatively unrestrained and the distance D in height between them varies when the frame 14 is collapsed (see FIG. 6). This provides for a very compact collapsed basket 10.

Figure 4:
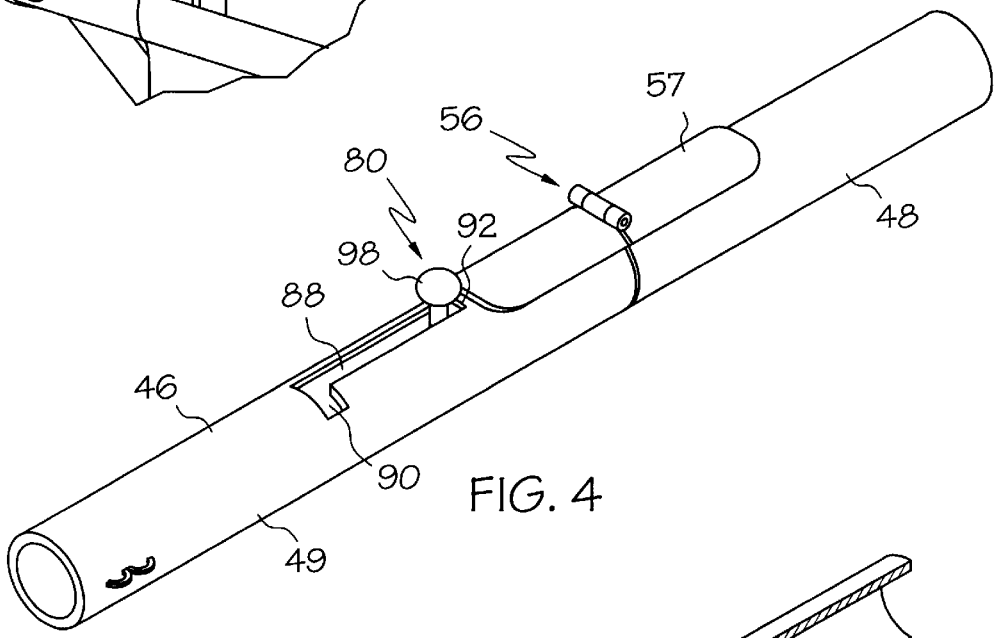
FIG. 4 is a perspective view illustration of an upper frame locking apparatus of the frame illustrated in FIG. 2.
Figure 5:
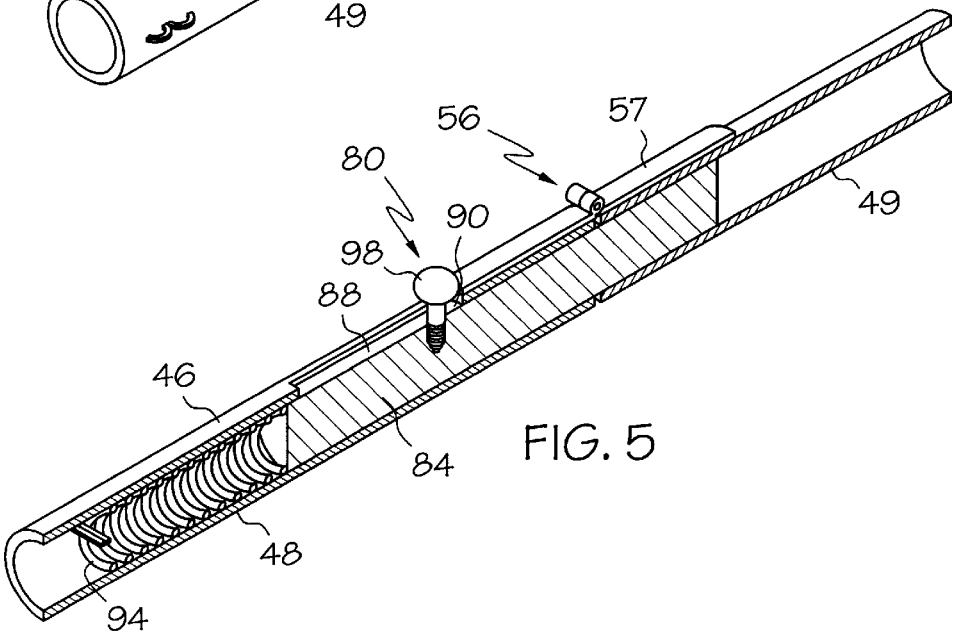
FIG. 5 is a cutaway perspective view illustration of the upper frame locking apparatus of the frame illustrated in FIG. 4.

Referring to FIGS. 4 and 5, the exemplary embodiment illustrated herein has a hinge 57 connecting the first and second sections 48, 49 to form the pivotable joint 56. Optional L shaped brackets 59 (seen in FIGS. 1 and 2) are welded, screwed, or otherwise mounted to a bottom and side of one of the first and second sections 48, 49 and rests flush against the other of the first and second sections when the side member 46 is straight. The leg members 24, 26 and the side members 46 are tubular with a circular cross-section in the exemplary embodiment illustrated herein but need not be so limited in other embodiments of the invention. Illustrated in the FIGS. are pin joints 76, including clevis joints and single lug pin joints, used in the exemplary embodiment for making pivotable connections between the frame elements. The single lug pin joints 76 have a lug 77 on one of the blocks with a hole 78 therethrough, another hole 78 through each pivotably connected element, and a pin 79 disposed through the holes as illustrated in FIG. 1.

A locking means 80 is used for locking the side members 46 in a straight position about the pivotable joint 56 or hinge 57. The side members 46 are locked in the straight position when the frame has been fully expanded after having been collapsed. An exemplary locking means 80 is illustrated in FIGS. 4 and 5 and includes spring loaded cylindrical bolts 84 disposed within the tubular side members 46. The bolts 84 that are extendable and retractable across the pivotable joints 56. A longitudinally extending bolt slot 88 extends across both of the first and second sections 48, 49 of each of the side members 46. A locking slot 90 extends transversely from the bolt slot 88 at a slot end 92 of the locking slot in one of the first and second sections 48, 49. A spring 94 is disposed within and secured to the same one of the first and second sections 48, 49 that has the locking slot 90. The spring 94 engages the bolt 84 so as to spring load it when the bolt is retracted into the same one of the first and second sections 48, 49 as the locking slot 90. A knob 98 extends radially outwardly from the bolt 84 through the bolt slot 88 and is suitably adapted to slide into the locking slot 90 when the bolt 84 is sufficiently retracted, thus, locking the bolt 84 in place. When the bolts 84 are all locked in place, the frame can be straightened out or collapsed. When the frame 14 is being assembled after the frame is substantially fully straightened, the bolts 84 are turned using the knobs 98 which disengages the knobs from the locking slots 90. This causes the spring loaded bolts to spring forward into the other one of the first and second sections 48, 49 not having the locking slot 90 and locking the straightened out frame 14 in the uncollapsed position.

Figure 3:
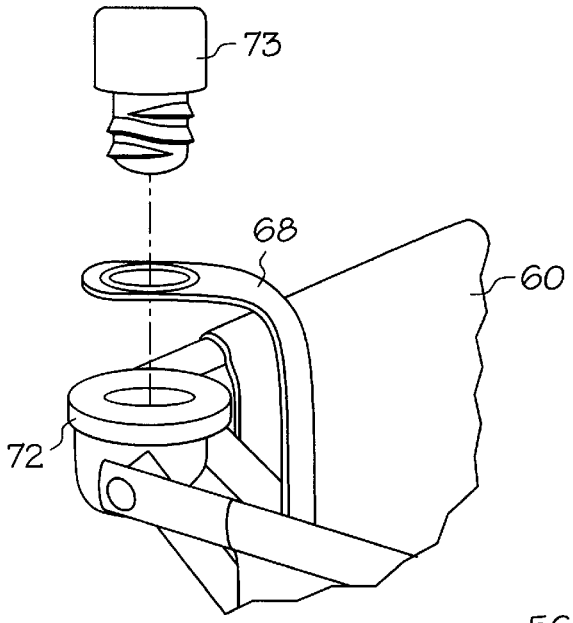
FIG. 3 is a perspective view illustration of an upper frame block of the frame illustrated in FIG. 2.

Referring to FIG. 1, a bag 60 made of a flexible or pliable material has multiple sides 64, four in the exemplary embodiment illustrated herein, that are attached to a bottom 66. The bag 60 has an open top 67 and is supportably connected to the sub-frame 16. The bag may be made of canvas or some other pliable material. The bag 60 is removably attached to the sub-frame using flaps 62 that loop over and are secured to the side members 46 using a removable fastening means such as velcro or a clip and corner tabs 68 removably attached to the upper blocks 72 by a screw 73 as more clearly illustrated in FIG. 3. The corner tabs 68 are optional and many other fastening devices may used to attach the bags 60 to the sub-frame 16 such as screws or snaps on the flaps 62. Optionally, wheels or removable casters 100, as illustrated in FIG. 1, are mounted to the lower blocks 70.

Figure 7:
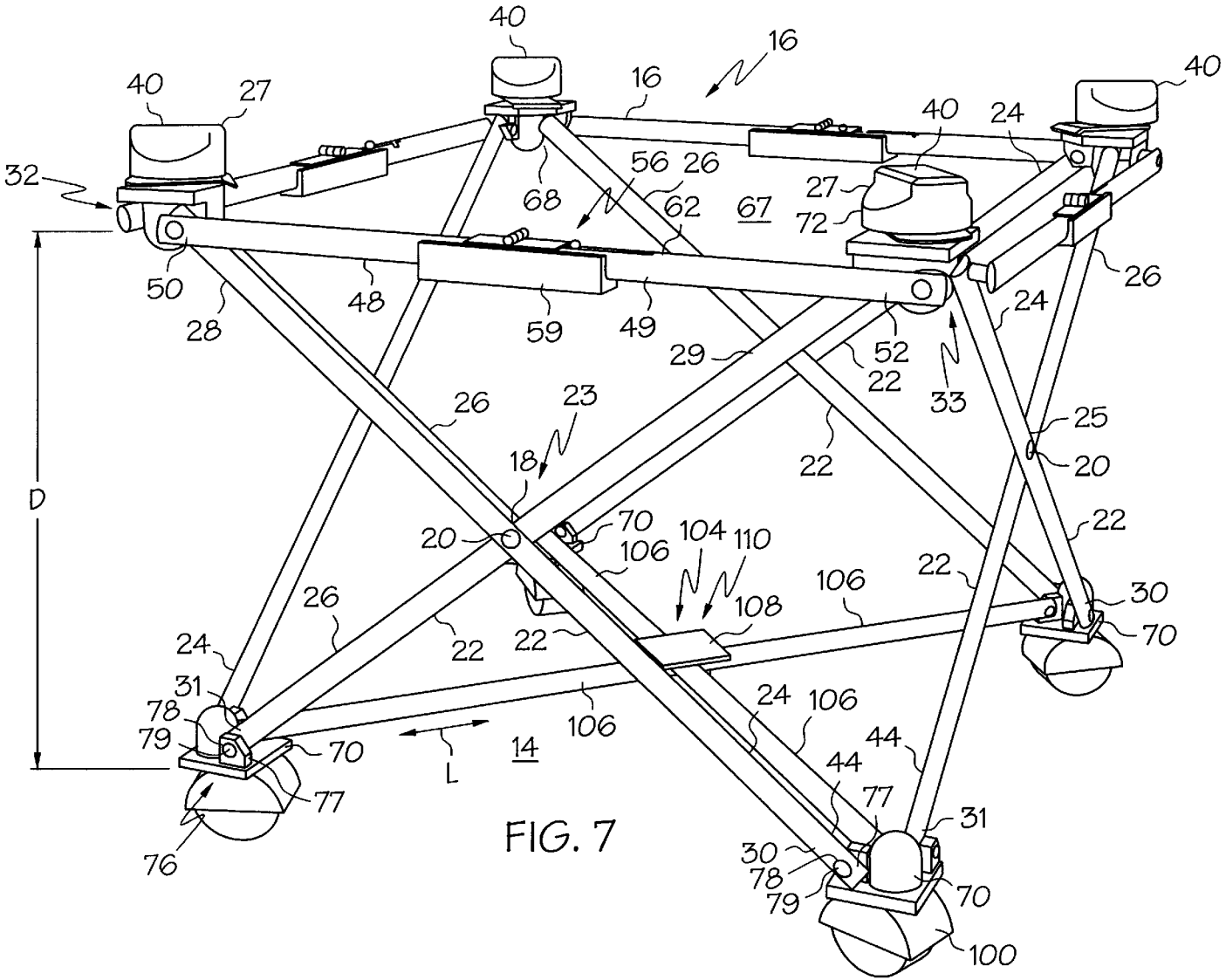
FIG. 7 is a perspective view illustration of an alternate embodiment frame of the collapsible basket illustrated in FIG. 1.
Figure 8:
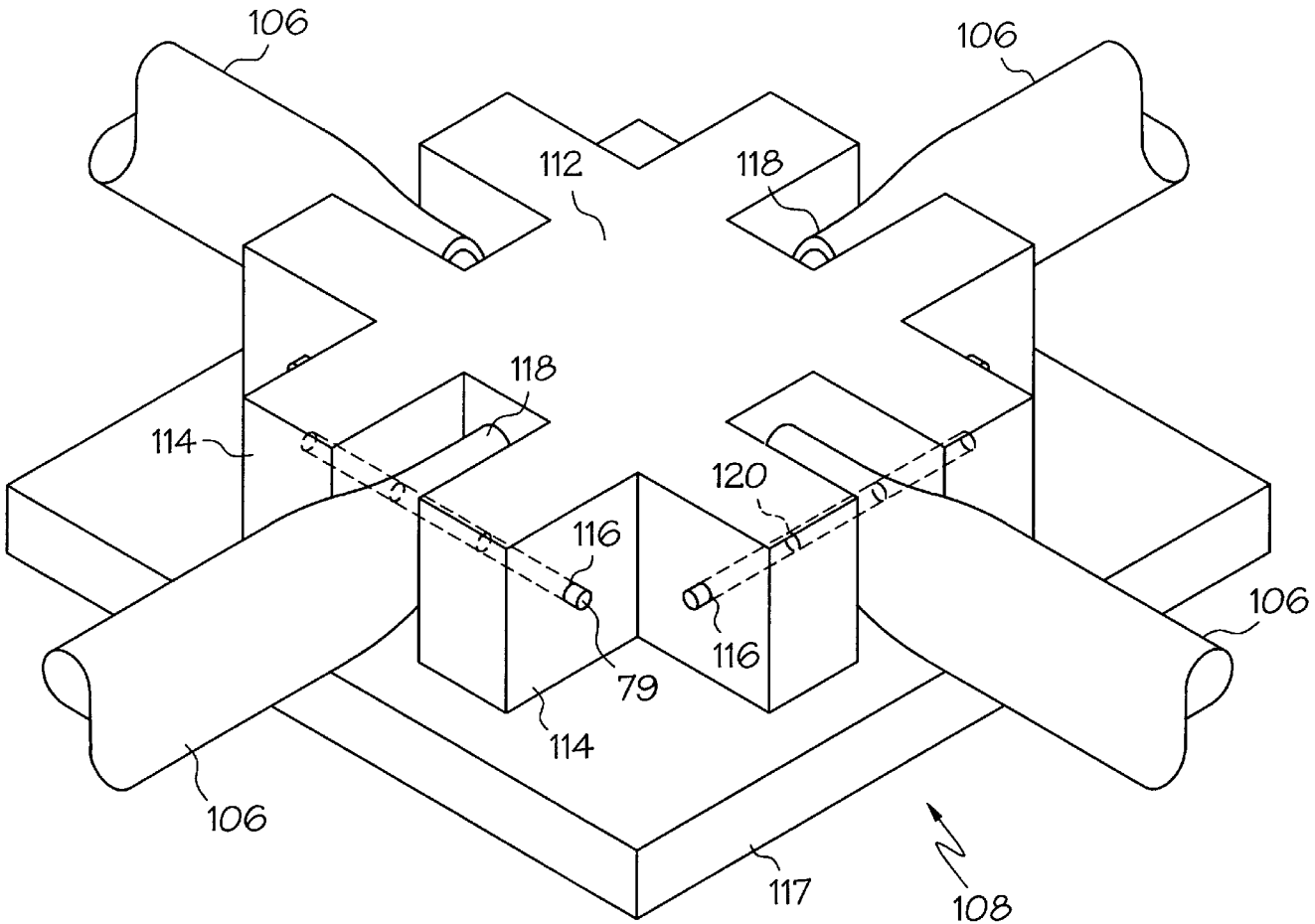
FIG. 8 is a bottom looking up perspective view illustration of cross bracing in the alternate embodiment frame illustrated in FIG. 7.

Illustrated in FIG. 7 is an alternative embodiment of the frame 14 which further includes collapsible cross bracing 104 extending between the lower blocks 70. The cross bracing 104 has bracing members 106 pivotably connected to the lower blocks 70 and pivotably connected to each other with a central block 108 at a central location 110 between the bracing members. Referring to FIG. 8, the central block 108 has a lower portion 112 with pairs of lugs 114 having axially aligned first holes 116 therethrough. The bracing members 106 have bracing member ends 118 that are disposed between the pairs of the lugs 114. Second holes 120 disposed through the bracing member ends 118 are axially aligned with the first holes 116. A pin 79 is disposed through the second holes 120 and the first holes 116. An upper portion 117 of the central block 108 is flat and positioned with respect to the bracing member ends 118 and the pairs of lugs 114 and the bracing members 106, such that when the frame 14 is fully straightened, the upper portion engages the bracing members and restrains the bracing members in a planar flat position, such that the cross bracing 104 is fully extended in a lengthwise longitudinal direction L of the bracing members.

What is claimed is:

1. A collapsible basket comprising:

a frame comprising;

a collapsible sub-frame supported solely by collapsible frame sides, each of said frame sides comprising a single pair of first and second leg members, said first and second leg members having first and second upper and lower ends, said first and second upper ends of each of said pair of first and second leg members pivotably connected to said sub-frame at pairs of relative spaced apart first and second positions on said sub-frame, said first position in one of said pairs of relative spaced apart first and second positions is said second position in an adjacent one of said pairs of relative spaced apart first and second positions, said first and second lower ends of adjacent ones of said pairs of first and second leg members in adjacent ones of said frame sides respectively being pivotably connected, said sub-frame having side members extending between said first and second positions on said sub-frame, each of said side members having first and second side ends pivotably connected to corresponding ones of said first and second upper ends of each of said pair of first and second leg members respectively, each of said side members having a pivotable joint between said first and second side ends;

a bag supportably connected to said sub-frame, and said bag comprising multiple sides attached to a bottom and an open top.

2. A collapsible basket as claimed in claim 1 further comprising lower blocks pivotably connected to said first and second lower ends of adjacent ones of said pair of first and second leg members and upper blocks pivotably connected to said first and second upper ends of adjacent ones of said pair of first and second leg members and corresponding side members.

3. A collapsible basket as claimed in claim 2 further comprising a locking means for locking said side members in a straight position about said pivotable joint between said first and second side ends.

4. A collapsible basket as claimed in claim 3 wherein said locking means comprises spring loaded bolts disposed within said side members and extendable and retractable across said pivotable joints.

5. A collapsible basket as claimed in claim 4 wherein said bag is removably attached to said subframe.

6. A collapsible basket as claimed in claim 4 wherein said locking means further comprises:

a bolt slot longitudinally extending across said first and second side sections of each of said side members, a locking slot extending transversely from said bolt slot at a slot end of said locking slot in one of said first and second sections, a spring disposed within and secured to same one of said first and second sections that has said locking slot, said spring engaging said bolt so as to spring load said bolt when said bolt is retracted into said same one of said first and second sections, and a knob extending radially outwardly from said bolt through said bolt slot and suitable to slide into said locking slot when said bolt is sufficiently retracted.

7. A collapsible basket as claimed in claim 5 wherein said bag includes corner tabs removably attached to said upper blocks.

8. A collapsible basket as claimed in claim 7 wherein said lower blocks are pivotably connected to said first and second lower ends of adjacent ones of said pair of first and second leg members and said upper blocks pivotably connected to said first and second upper ends of adjacent ones of said pair of first and second leg members and corresponding side members by pin joints.

9. A collapsible basket as claimed in claim 8 further comprising wheels mounted to said lower blocks.

10. A collapsible basket as claimed in claim 8 further comprising removable casters mounted to said lower blocks.

11. A collapsible basket as claimed in claim 8 further comprising collapsible cross bracing between said lower blocks said cross bracing comprising bracing members pivotably connected to said lower blocks and pivotably connected to each other at a central location between said bracing members.

12. A collapsible basket as claimed in claim 5 wherein said leg members and said side members are tubular and said bag is made of a pliable material.

13. A collapsible basket as claimed in claim 12 wherein said bag includes corner tabs removably attached to said upper blocks.

14. A collapsible basket as claimed in claim 13 wherein said lower blocks are pivotably connected to said first and second lower ends of adjacent ones of said pair of first and second leg members and said upper blocks pivotably connected to said first and second upper ends of adjacent ones of said pair of first and second leg members and corresponding side members by pin joints.

15. A collapsible basket as claimed in claim 14 further comprising wheels mounted to said lower blocks.

16. A collapsible basket as claimed in claim 14 further comprising removable casters mounted to said lower blocks.

17. A collapsible basket as claimed in claim 16 further comprising collapsible cross bracing between said lower blocks said cross bracing comprising bracing members pivotably connected to said lower blocks and pivotably connected to each other at a central location between said bracing members.

18. A collapsible basket as claimed in claim 17 wherein said bracing members are pivotably connected to central block at said central location.

19. A collapsible basket as claimed in claim 17 wherein said pliable material is canvas.

20. A collapsible basket as claimed in claim 2 wherein said first and second leg members in each of said frame sides are not connected to each other and a distance in height between said upper lower blocks is changed when said frame is collapsed and expanded.

* * * * *